US006791252B2

(12) United States Patent
Kim et al.

(10) Patent No.: US 6,791,252 B2
(45) Date of Patent: Sep. 14, 2004

(54) DEFLECTION YOKE WITH QUADRANGULAR SEPARATOR

(75) Inventors: Jung Sub Kim, Suwon-shi (KR); Seoung Chun Kim, Suwon-shi (KR); Cheong Moon Lee, Sungnam-shi (KR); Hwan Seok Choi, Suwon-shi (KR)

(73) Assignee: Samsung Electric-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/113,521

(22) Filed: Mar. 28, 2002

(65) Prior Publication Data

US 2002/0140337 A1 Oct. 3, 2002

(30) Foreign Application Priority Data

Mar. 28, 2001 (KR) ..... 2001-16139
Sep. 10, 2001 (KR) ..... 2001-55390

(51) Int. Cl.[7] ..... H01J 29/70

(52) U.S. Cl. ..... 313/440; 313/477 R; 335/209; 335/296; 252/62.51

(58) Field of Search ..... 313/440, 477 R; 335/209, 296; 252/62.51

(56) References Cited

U.S. PATENT DOCUMENTS 6,069,546 A * 5/2000 Azzi et al. ..... 335/210
6,380,698 B1 * 4/2002 Dasgupta ..... 315/368.25
6,404,117 B1 * 6/2002 Soneda et al. ..... 313/440
6,452,321 B1 * 9/2002 Kojima ..... 313/440
6,559,587 B1 * 5/2003 Inoue et al. ..... 313/440

FOREIGN PATENT DOCUMENTS

EP 000991104 A2 * 5/2000

* cited by examiner

*Primary Examiner*—Ashok Patel
*Assistant Examiner*—Holly Harper
(74) *Attorney, Agent, or Firm*—Darby & Darby

(57) ABSTRACT

Disclosed is a deflection yoke which is so configured that a coil separator and horizontal deflection coils have angular cross sectional shapes and a ferrite core and vertical deflection coils have circular cross sectional shapes to improve deflection sensitivity thereby reducing power consumption.

6 Claims, 5 Drawing Sheets

DEFLECTION YOKE WITH QUADRANGULAR SEPARATOR

BACKGROUND OF THE INVENTION

1. Field of the invention

The present invention relates to a deflection yoke, in particular, which can reduce power consumption while elevating deflection sensitivity.

2. Description of the Prior Art

In general, a Cathode Ray Tube (CRT) in a television or a monitor has a deflection yoke for correctly deflecting RGB beams scanned from an electron gun to a fluorescent screen applied on a screen of the CRT. Such a deflection yoke functioning as one of the most important magnetic components in the CRT serves to deflect the electron beams from the electron gun so that electric signals transmitted in time sequence can be reproduced as images on the screen of the CRT.

In other words, since the electron beams project ed from the electron gun directly move onto the screen with a high voltage to light only central phosphors in the screen, the deflection yoke externally deflects the electron beams in the order of scanning. Here, the deflection yoke forms a magnetic field to deflect the electron beams correctly to the fluorescent screen applied on the screen of the CRT based upon the fact that the electrons are forced to change the course thereof while passing through the magnetic field.

FIG. 1 is a side elevation view for showing a general CRT. As shown in FIG. 1, a deflection yoke 4 is placed in an RGB electron gun section 3 of the CRT 1 to deflect electron beams scanned from an electron gun 3*a* toward a fluorescent screen applied on a screen surface 2.

Such a deflection yoke 4 comprises a coil separator 10 constituted of a pair of symmetric upper and lower parts which are coupled into one unit.

The coil separator 10 is provided to mutually insulate horizontal deflection coils 15 and vertical deflection coils 16 while assembling the same at suitable positions, and comprised of a screen portion 11*a* for being coupled to one side of a screen surface of the CRT 1, a rear cover 11*b* and a neck portion 12 integrally extended from a central surface of the rear cover 11*b* for being coupled to the electron gun section 3 of the CRT 1.

The coil separator 10 is respectively provided in the inner and outer peripheries with the horizontal deflection coils 15 and the vertical deflection coils 16 for forming horizontal magnetic deflection and vertical magnetic deflection via externally applied power.

Further, a pair of ferrite cores 14 made of a magnetic substance are installed to wrap the vertical deflection coils 16 to strengthen the vertical magnetic deflection generated from the vertical deflection coils 16.

The deflection yoke 4 configured like this is installed in the neck portion 12 of the CRT 1. When the horizontal deflection coils 15 and the vertical deflection coils 16 are applied with a sawtooth wave pulse, the deflection yoke 4 generates the magnetic field based on the Fleming's left hand rule to deflect the RGB electron beams emitted from the electron gun 3*a* of the CRT so as to determine scanning positions on the screen.

In the above deflection yoke 4, the deflection coils and ferrite cores 14 as well as the coil separator 10 are designed according to the tube shape of the CRT 1.

As shown in FIG. 2, in other words, the conventional deflection yoke 100 is configured to have horizontal deflection coils 120 for forming a horizontal magnetic deflection and vertical deflection coils 130 for forming a vertical magnetic deflection, in which the horizontal deflection coils 120 are provided in the inner periphery and the vertical deflection coils 130 are provided in the outer periphery about the coil separator 110 so that the coils 120 and 130 form concentric circles.

The vertical deflection coils 130 are provided in the outer periphery with a ferrite core 140 for strengthening the vertical magnetic deflection from the vertical deflection coils 130 as above. The ferrite core 140 also has a circular sectional shape.

As shown in FIG. 3, the coil separator 110 is formed into the shape of a funnel in general, and comprised of a screen portion 111 having a large diameter, a neck portion 114 having a small diameter, a body 112 connecting between the screen portion 111 and the neck portion 114 and a rear cover 113 having the shape of boards at a position adjacent to the neck portion 114. The coil separator 110 mutually insulates the horizontal deflection coils 120 and the vertical deflection coils 130, as shown in FIG. 2, while maintains the same in suitable positions.

In the conventional deflection yoke 100, however, the CRT section to which the deflection yoke 100 is attached is manufactured into a circular shape due to difficulty in manufacture even though the screen surface of the CRT has a rectangular shape with an aspect ratio of 4:3 or 16:9 thereby resulting in problems that enhancement of deflection sensitivity is restricted and power consumption increases as well.

As CRTs of TVs or monitors are flattened or large sized recently, the CRTs require those deflection yokes which can guarantee high deflection sensitivity. However, since the deflection yokes have circular cross sections, there are limitations in increasing deflection efficiencies according to traces of the electron beams.

In order to solve the above problems, a ferrite core having a quadrangular cross section was proposed in the prior art. However, the following problems are incurred in forming the ferrite core into the quadrangular shape.

In general, since the ferrite core is formed through compression molding, it has a very poor workability. Also, the ferrite core requires a precise working process thereby lowering the productivity and increasing the manufacturing cost by a large margin.

In other words, the ferrite core having the cross section manufactured into the angled shape has an ununiform contraction dispersion which is generated by a large amount in a plastic deformation process over the ferrite core having the circular cross section. This accompanies a working process for improving the dispersion, thereby increasing the number of process steps and lowering the yield.

SUMMARY OF THE INVENTION

Accordingly, the present invention has been made to solve the above problems and it is an object of the present invention to provide a deflection yoke which comprises a coil separator and horizontal deflection coils having angular cross sectional shapes and a ferrite core and vertical deflection coils having circular cross sectional shapes to improve deflection sensitivity thereby reducing power consumption.

It is another object of the invention to provide a deflection yoke which comprises support structures in an outer periphery of a coil separator at the same interval for supporting horizontal deflection coils with an angular cross section, vertical deflection coils with a circular cross section and a ferrite core so as to improve deflection sensitivity as well as enhance mass productivity.

According to an aspect of the invention, it is provided a deflection yoke comprising: a coil separator formed into the shape of a quadrangular pyramid with a quadrangular cross section, and comprising a screen portion coupled to a screen of a CRT and a neck portion integrally extended from said screen portion and coupled to an electron gun section of the CRT; horizontal and vertical deflection coils provided in inner and outer peripheries of said coil separator for forming magnetic deflections to deflect electron beams in horizontal and vertical directions; and a ferrite core provided in the outside of said coil separator and having a substantially conical shape for strengthening the magnetic deflections.

The deflection yoke is further characterized in that said vertical deflection coils closely contact to an outer surface of said coil separator.

The deflection yoke is characterized in that said vertical deflection coils closely contact to an inner surface of said ferrite core.

The deflection yoke is further characterized in that said horizontal deflection coils are angularly wound to closely contact to an inner surface of said coil separator, and said vertical deflection coils are circularly wound to closely contact to an inner surface of said ferrite core.

The deflection yoke is still characterized in that said horizontal deflection coils have a rectangular cross sectional shape with an aspect ratio of 4:3 or 16:9.

According to another aspect of the invention, it is provided a deflection yoke comprising: a coil separator comprising a screen portion coupled to one side of a screen surface of a CRT, a neck portion coupled to an electron gun section of the CRT, and a body having the shape of a quadrangular pyramid with a quadrangular cross section for connecting said screen portion and said neck portion; horizontal and vertical deflection coils provided in inner and outer peripheries of said coil separator for forming magnetic deflections to deflect electron beams in horizontal and vertical directions; a ferrite core provided in an outer surface of said coil separator and made of a magnetic substance for strengthening the magnetic deflections; and at least one support rib integrally projected along an outer surface of said coil separator for uniformly supporting an inner surface of said ferrite core.

The deflection yoke is characterized in that said support rib is provided at positions in an outer periphery of said body adjacent to said screen portion and said neck portion, and has a curvature for uniformly contacting to upper and lower inner peripheries of said ferrite core having the circular cross section.

The deflection yoke is further characterized in that said vertical deflection coils are angularly shaped for closely contacting to an outer surface of said coil separator.

The deflection yoke is characterized in that said vertical deflection coils uniformly contact to an inner surface of said ferrite core.

The deflection yoke is further characterized in that said horizontal deflection coils are angularly wound for closely contacting to an inner surface of said coil separator, and said vertical deflection coils are circularly wound for closely contacting to an inner surface of said ferrite core.

The deflection yoke is further characterized in that said coil separator comprises: symmetric right and left parts joining into one unit; and insulation ribs integrally projected from interfaces of said right and left parts for mutually insulating right and left parts of said vertical deflection coils.

The deflection yoke is still characterized in that said horizontal deflection coils have a rectangular cross sectional shape with an aspect ratio of 4:3 or 16:9.

DETAILED DESCRIPTION OF THE PREFERRED EMBODIMENT

Hereinafter it will be described in detail about preferred embodiments of the invention in reference to the accompanying drawings.

Figure 1:
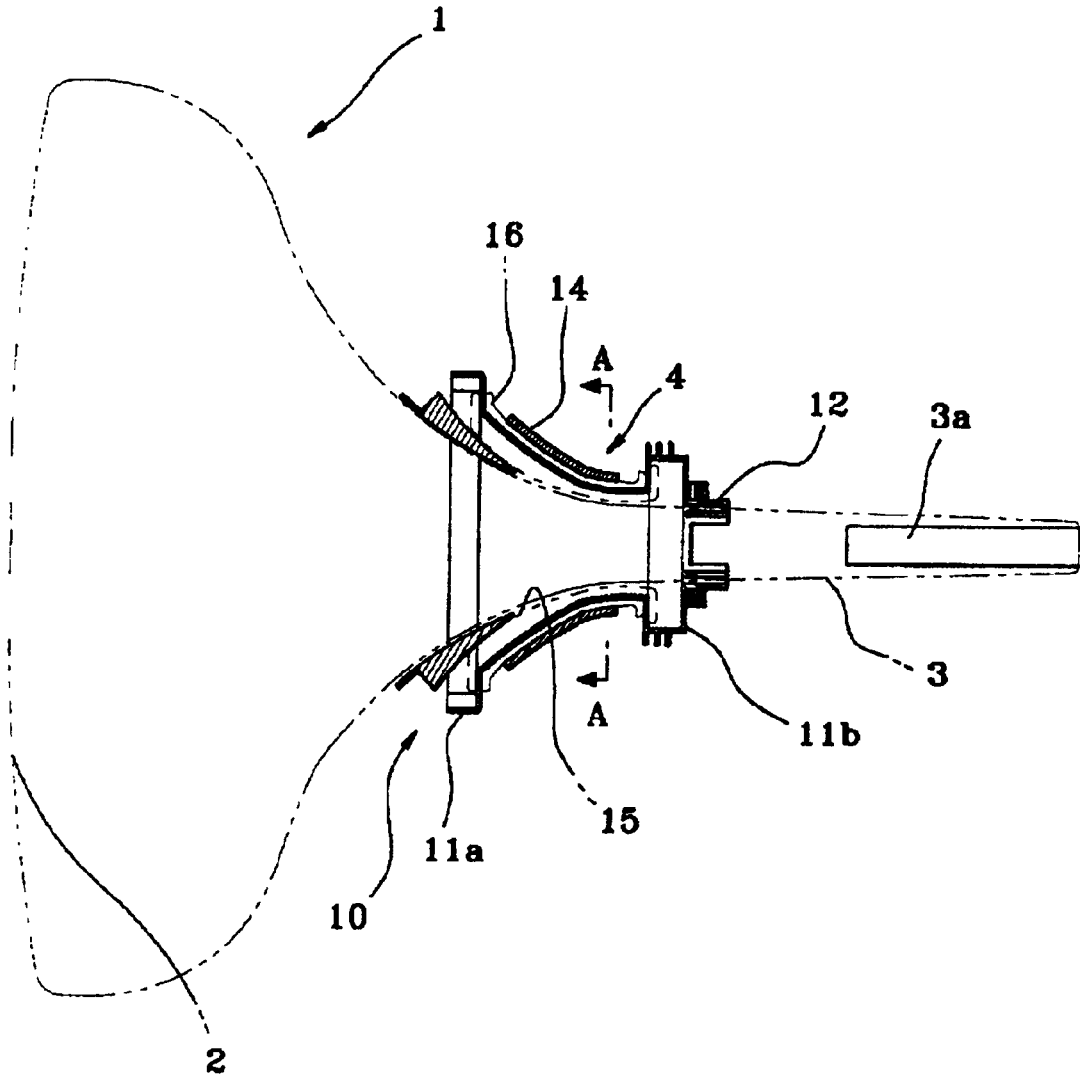
Fig. 1 (CONVENTIONAL ART)
FIG. 1 is a side elevation view illustrating a general CRT.
Figure 2:
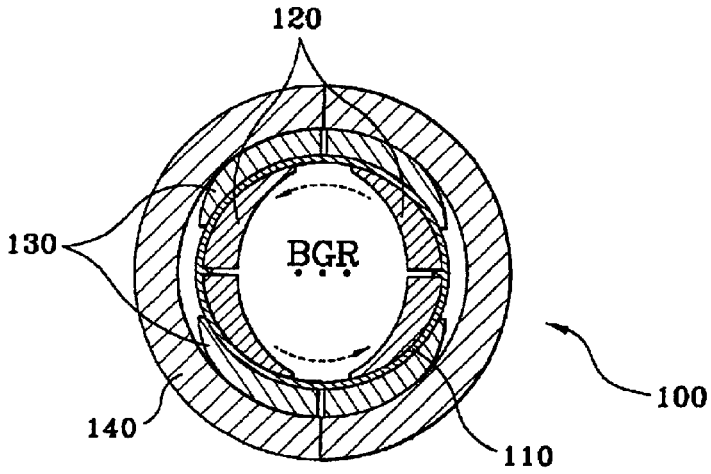
Fig. 2 (CONVENTIONAL ART)
FIG. 2 is a sectional view illustrating a cross section of a conventional CRT cut along "A—A" line shown in FIG. 1.
Figure 3:
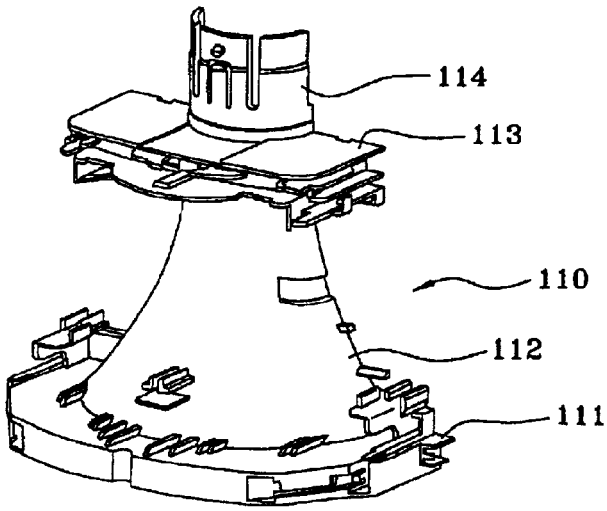
Fig. 3 (CONVENTIONAL ART)
FIG. 3 is a perspective view illustrating a coil separator in a deflection yoke of the prior art.
Figure 4:
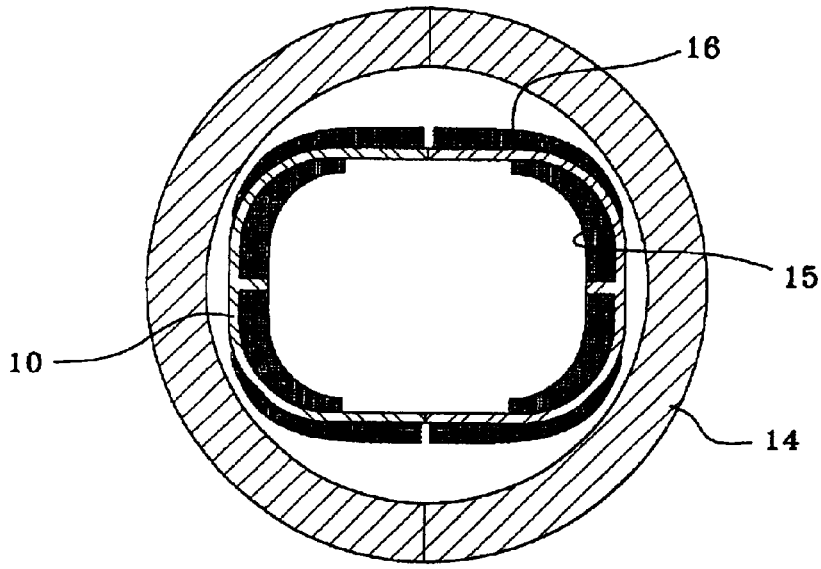
FIG. 4 is a sectional view illustrating a cross section of a CRT of the invention cut along "A—A" line shown in FIG. 1.
Figure 6:
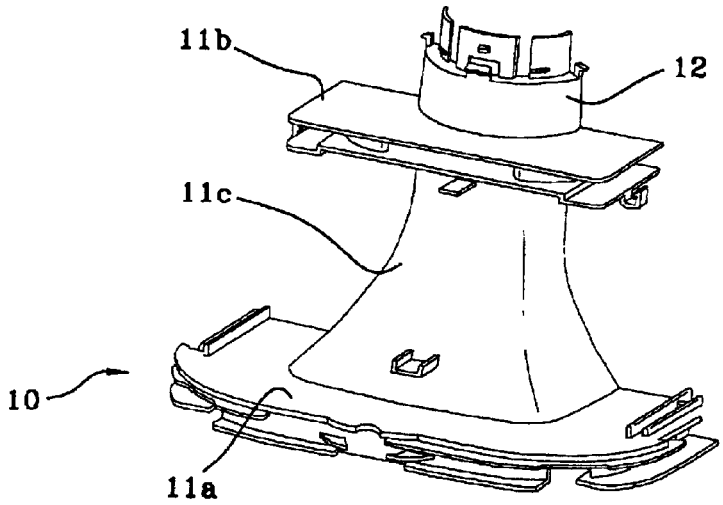
FIG. 6 is a perspective view illustrating a coil separator in a deflection yoke of the invention.

FIG. 4 is a sectional view illustrating a cross section of a CRT of the invention cut along "A—A" line shown in FIG. 1, and FIG. 6 is a perspective view illustrating a coil separator in a deflection yoke of the invention.

Hereinafter description will be made in reference to FIG. 1, in which the same reference numerals are used throughout the different drawings to designate the same or similar components.

As shown in FIG. 1, a deflection yoke 4 comprises a coil separator 10 made of a pair of separate molded articles which are divided into symmetric upper and lower parts and coupled into one unit. The separator 10 comprises a screen portion 11*a* having a large diameter connected to one side of a screen surface 1 of the CRT 1 and a neck portion 12 having a small diameter coupled to an electron gun section 3 of the CRT 1.

The coil separator 10 is provided with horizontal deflection coils 15 in the inner periphery and vertical deflection coils 16 in the outer periphery for forming a horizontal magnetic deflection and a vertical magnetic deflection, respectively, in response to external power application. The coil separator 10 mutually insulates the horizontal and vertical deflection coils 15 and 16 and maintain the same at suitable positions.

In the outer peripheries of the vertical deflection coils 16, is provided a ferrite core 14 wrapping the vertical deflection coils 16 and made of a magnetic substance for strengthening the vertical magnetic deflection.

The above configuration is similar to that of a conventional deflection yoke. However, the invention is characterized in that the coil separator 10 is designed into the shape of a quadrangular pyramid and the ferrite core 14 is designed into the shape of a cone excellent in mass-productivity in order to enhance deflection sensitivity.

In the deflection yoke of the invention having the above characteristics, as shown in FIG. 4, the coil separator 10, the horizontal deflection coils 15 and the vertical deflection coils 16 are formed to have quadrangular sectional shapes, respectively, and the ferrite core 14 is formed to have a circular sectional shape.

The coil separator 10 is so formed that the diameter thereof increases from the neck portion 12 toward the screen portion 11*a* and the cross section thereof has the quadrangular shape, and provided with the above horizontal and vertical deflection coils 15 and 16 in the inner and outer peripheries.

Describing the configuration in more detail, as shown in FIG. 6, the coil separator 10 comprises the screen portion 11*a* having the large diameter coupled to one side of the screen surface of the CRT 1, the neck portion 12 having the small diameter coupled to the electron gun section 3 of the CRT 1, the rear cover 11*b* and a body 11*c* connecting between the screen portion 11*a* and the neck portion 12. The body 11*c* is so formed to have the shape of a substantially quadrangular pyramid which flares from the screen portion 11*a* toward the neck portion 12.

Each of the horizontal deflection coils 15 and the vertical deflection coils 16 have an angularly wound configuration so as to be provided adjacent to each of the inner and outer peripheries of the coil separator 10 when seen from the drawing.

The ferrite core 14 is so mounted to wrap the vertical deflection coils 16, and so formed to have a circular cross sectional shape, as shown in FIG. 4, while the body 11*c* of the coil separator 10 has the angular cross section as above.

When the coil separator 10, the horizontal deflection coils 15 and the vertical deflection coils 16 are so formed to have the angular cross sections as set forth above, magnetic field features of the deflection coils elevate the deflection efficiency according to the traces of the electron beams, resultantly improving deflection sensitivity as well as decreasing power consumption.

Further, forming the ferrite core 14 into the circular cross sectional shape allows a uniform dispersion of contraction in a plastic deformation process, thereby restricting the convergence and distortion dispersion.

Figure 5:
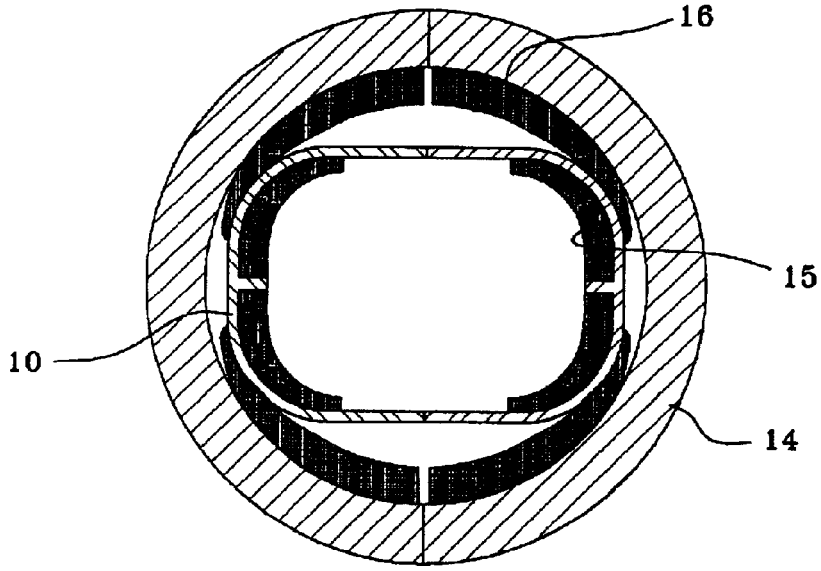
FIG. 5 is a sectional view illustrating an alternative embodiment of FIG. 4.

In the meantime, FIG. 5 is a sectional view illustrating an alternative embodiment of FIG. 4. As shown in FIG. 5, the vertical deflection coils 16 are angularly wound as closely contacting with the inner surface of the ferrite core 14.

Preferably, the horizontal deflection coils 15 are provided into the shape of a rectangle having an aspect ratio of 4:3 or 16:9 corresponding to the shape of the screen surface of the CRT. In other words, the horizontal deflection coils 15 are so wound to have a rectangular cross sectional shape having the aspect ratio of 4:3 or 16:9.

When the vertical deflection coils 16 are provided adjacent to the inner surface of the ferrite core 14 as set forth above, the vertical deflection coils 16 are resultantly provided into the shape corresponding to the circular cross sectional shape of the ferrite core 14.

Then, the body 11*c* of the coil separator 10 and the horizontal deflection coils 15 are provided to have the angular cross sections, whereas the ferrite core 14 and the vertical deflection coils 16 are provided to have the circular cross sections.

According to magnetic field features between the horizontal deflection coils 15 having the angular configuration and the vertical deflection coils 16 having the circular configuration as above, the deflection efficiency according to the traces of the electron beams can be enhanced, resultantly improving deflection sensitivity and decreasing power consumption.

Figure 7:
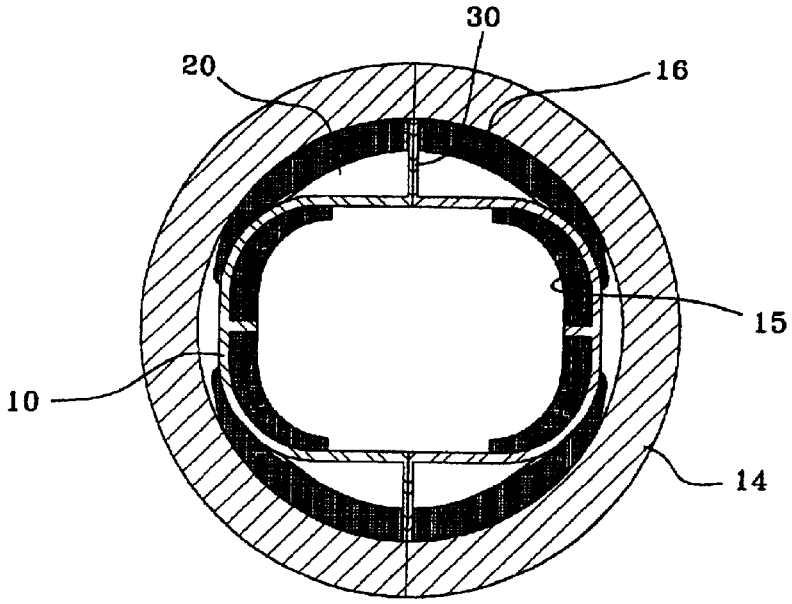
FIG. 7 is a sectional view illustrating an alternative embodiment of FIG. 5.
Figure 8:
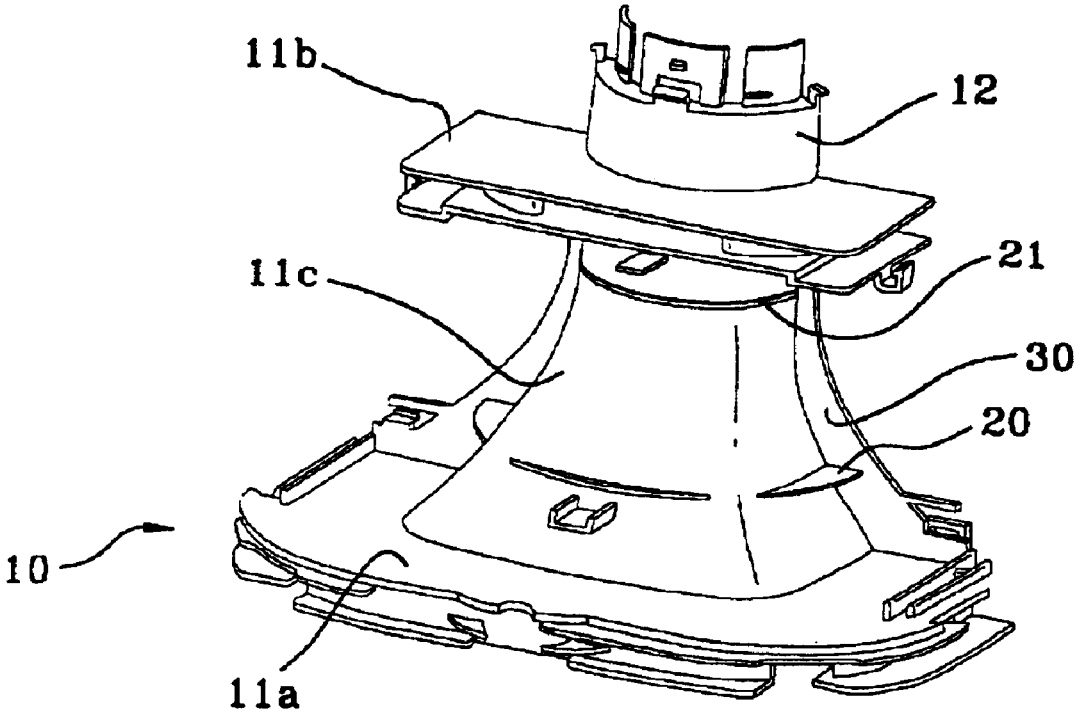
FIG. 8 is a perspective view illustrating a coil separator in FIG. 7.

In the deflection yoke configured as above, as the body 11*c* of the coil separator 10 has the quadrangular pyramid shape, it is expected that the vertical deflection coils 16 and the ferrite core 14 provided in the outside of the body 11*c* to play. Support ribs 20 and 21, as shown in FIGS. 7 and 8, securely support the vertical deflection coils 16 and the ferrite core 14 to prevent the play.

Describing this in more detail, since the coil separator 10 is manufactured into the shape having the quadrangular cross section, the vertical deflection coils 15 having the quadrangular cross sectional shape can be provided adjacent to the inner side of the coil separator 10. Further, the generally circularly shaped support ribs 20 and 21 formed in the outside of the body 11*c* can uniformly support the vertical deflection coils 16 and the ferrite core 14 having the circular cross sectional shapes.

At least one of the support ribs 20 and 21 is provided in the outer periphery of the body 11*c*. As shown in FIG. 8, the support ribs 20 and 21 are provided in upper and lower portions of the body 11*c*, i.e. at positions adjacent to the neck portion 12 and the screen portion 11*a*, respectively. Each of the ribs 20 and 21 is projected to have a shape corresponding to the inner periphery of the vertical deflection coils 16 having the circular cross section, i.e. a generally circular shape when seen from the body 11*c*.

The each support rib 20 or 21 is so projected along the periphery of the body 11*c* to have a curvature uniformly contacting to the inner periphery of the vertical deflection coils 16.

In the meantime, the coil separator 10 with the separate right and left symmetric parts joining into the one unit has insulation ribs 30 integrally projected from interfaces of the joined parts. Preferably, the insulation ribs 30 insulate the vertical deflection coils 16 having a pair of right and left parts.

According to the body 11*c* of the coil separator 10 and the horizontal deflection coils 15 having the angular cross sections and the vertical deflection coils 16 and the ferrite core 14 having the circular cross sections as set forth above, the deflection yoke of the invention has the magnetic features for enhancing the deflection sensitivity of the electron beams. In particular, the ferrite core 14 is manufactured into the conical shape simplifying mass-production so that contraction dispersion can be reduced by a large amount in a plastic deformation process.

The deflection sensitivity of the electron beams is enhanced to restrict convergence and distortion dispersion as well as reduce the amount of power consumption compared to the conventional art, resultantly having effects that further enhances the quality of articles and increases the reliability thereof as well.

Further, the support ribs 20 and 21 have the supporting structure which more securely places the vertical deflection coils 16 and the ferrite core 14 on the coil separator 10 thereby preventing defects of the articles due to play thereof.

What is claimed is:

1. A deflection yoke comprising:

a coil separator formed into the shape of a quadrangular pyramid with a quadrangular cross section, and comprising a screen portion coupled to a screen of a CRT and a neck portion integrally extended from said screen portion and coupled to an electron gun section of the CRT;

horizontal and vertical deflection coils provided in inner and outer peripheries of said coil separator for forming magnetic deflections to deflect electron beams in horizontal and vertical directions; and a ferrite core provided in the outside of said coil separator and having a substantially conical shape for strengthening the magnetic deflections;

wherein said horizontal deflection coils are angularly wound to closely contact to an inner surface of said coil separator, and said vertical deflection coils are circularly wound to closely contact to an inner surface of said ferrite core.

2. The deflection yoke according to claim 1, wherein said vertical deflection coils closely contact to an outer surface of said coil separator.

3. The deflection yoke according to claim 1, wherein said vertical deflection coils closely contact to an inner surface of said ferrite core.

4. The deflection yoke according to claim 1, wherein said horizontal deflection coils have a rectangular cross sectional shape with an aspect ratio of 4:3.

5. The deflection yoke according to claim 1, wherein said horizontal deflection coils have a rectangular cross sectional shape with an aspect ratio of 16:9.

6. A deflection yoke comprising:

a coil separator comprising a screen portion coupled to one side of a screen surface of a CRT, a neck portion coupled to an electron gun section of the CRT, and a body having the shape of a quadrangular pyramid with a quadrangular cross section for connecting said screen portion and said neck portion;

horizontal and vertical deflection coils provided in inner and outer peripheries of said coil separator for forming magnetic deflections to deflect electron beams in horizontal and vertical directions;

a ferrite core provided in an outer surface of said coil separator and made of a magnetic substance for strengthening the magnetic deflections; and at least one support rib integrally projected along an outer surface of said coil separator for uniformly supporting an inner surface of said ferrite core;

wherein said horizontal deflection coils are angularly wound for closely contacting to an inner surface of said coil separator, and said vertical deflection coils are circularly wound for closely contacting to an inner surface of said ferrite core;

wherein said coil separator comprises:

symmetric right and left parts joining into one unit; and insulation ribs integrally projected from interfaces of said right and left parts for mutually insulating right and left parts of said vertical deflection coils.

* * * * *

UNITED STATES PATENT AND TRADEMARK OFFICE

CERTIFICATE OF CORRECTION

PATENT NO. : 6,791,252 B2
APPLICATION NO. : 10/113521
DATED : September 14, 2004
INVENTOR(S) : Jung S. Kim It is certified that error appears in the above-identified patent and that said Letters Patent is hereby corrected as shown below:

On the title page Item [73]

In the Assignee:

Please delete "Samsung Electric-Mechanics Co., Ltd." And substitute -- Samsung Electro-Mechanics Co., Ltd. --.

Signed and Sealed this

First Day of May, 2007

JON W. DUDAS
*Director of the United States Patent and Trademark Office*